US006340325B1

(12) United States Patent
Chen et al.

(10) Patent No.: US 6,340,325 B1
(45) Date of Patent: Jan. 22, 2002

(54) POLISHING PAD GROOVING METHOD AND APPARATUS

(75) Inventors: Shyng-Tsong Chen, Patterson, NJ (US); Alex Siu Keung Chung, Marlborough, MA (US); Kenneth M. Davis, Newburgh, NY (US); Oscar Kai Chi Hsu, Chelmsford, MA (US); Kenneth P. Rodbell, Sandy Hook, CT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/605,869

(22) Filed: Jun. 29, 2000

(51) Int. Cl.[7] ..... B24B 1/00
(52) U.S. Cl. ..... 451/56; 451/527
(58) Field of Search ..... 451/28, 56, 63, 451/285, 287, 288, 526, 527, 533, 539, 528, 529, 388, 364

(56) References Cited

U.S. PATENT DOCUMENTS 5,882,251 A * 3/1999 Berman et al. ..... 451/527
5,888,121 A * 3/1999 Kirchner et al. ..... 451/41
6,254,456 B1 * 7/2001 Kirchner et al. ..... 451/41

* cited by examiner

*Primary Examiner*—Derris H. Banks
(74) *Attorney, Agent, or Firm*—Connolly Bove Lodge & Hutz; Robert Trepp, Esq.

(57) ABSTRACT

Grooves are formed in a COD pad by positioning the pad on a supporting surface with a working surface of the pad in spaced relation opposite to a router bit and at least one projecting stop member adjacent to the router bit, an outer end portion of the bit projecting beyond the stop. When the bit is rotated, relative axial movement between the bit and the pad causes the outer end portion of the bit to cut an initial recess in the pad. Relative lateral movement between the rotating bit and the pad then forms a groove which extends laterally away from the recess and has a depth substantially the same as that of the recess. The depths of the initial recess and the groove are limited by applying a vacuum to the working surface of the pad to keep it in contact with the stop member(s). Different lateral movements between the bit and the pad are used to form a variety of groove patterns, the depths of which are precisely controlled by the stop member (s).

19 Claims, 6 Drawing Sheets

POLISHING PAD GROOVING METHOD AND APPARATUS

FIELD OF THE INVENTION

The present invention relates to the field of making polishing pads, and more specifically to providing macrotextured surfaces on polishing pads used in the chemical-mechanical planarization (CMP) of semiconductor substrates.

BACKGROUND OF THE INVENTION

Chemical-mechanical polishing has been used for many years as a technique for polishing optical lenses and semiconductor wafers. More recently, chemical-mechanical polishing has been developed as a means for planarizing intermetal dielectric layers of silicon dioxide and for removing portions of conductive layers within integrated circuit devices as they are fabricated on various substrates. For example, a silicon dioxide layer may cover a metal interconnect conformably such that the upper surface of the silicon dioxide layer is characterized by a series of non-planar steps corresponding in height and width to the underlying metal interconnects.

The step height variations in the upper surface of the intermetal dielectric layer have several undesirable characteristics. Such non-planar dielectric surfaces may interfere with the optical resolution of subsequent photolithographic processing steps, making it extremely difficult to print high resolution lines. Another problem involves the step created in the coverage of a second metal layer over the intermetal dielectric layer. If the step height is relatively large, the metal coverage may be incomplete such that open circuits may be formed in the second metal layer.

To combat these problems, various techniques have been developed to planarize the upper surface of the intermetal dielectric layer. One such approach is to employ abrasive polishing to remove the protruding steps along the upper surface of the dielectric layer. According to this method, a silicon substrate wafer is mounted face down beneath a carrier and pressed between the carrier and a table or platen covered with a polishing pad that is continuously coated with a slurried abrasive material.

Means are also provided for depositing the abrasive slurry on the upper surface of the pad and for forcibly pressing the substrate wafer against the polishing pad, such that movement of the platen and the substrate wafer relative to each other in the presence of the slurry results in planarization of the contacted face of the wafer. Both the wafer and the table may be rotated relative to each other to rub away the protruding steps. This abrasive polishing process is continued until the upper surface of the dielectric layer is substantially flat.

Polishing pads may be made of a uniform material such as polyurethane or nonwoven fibers impregnated with a synthetic resin binder, or may be formed from multilayer laminations having non-uniform physical properties throughout the thickness of the pad. Polyurethane polishing pads are typically formed by placing a reactive composition in a mold, curing the composition to form the pad material, and then die cutting the pad material into the desired size and shape. The reagents that form the polyurethane or the resin binder also may be reacted within a cylindrical container. After forming, a cylindrically shaped piece of pad material is cut into slices that are subsequently used as the polishing pad. A typical laminated pad may have a plurality of layers, such as a spongy and resilient microporous polyurethane layer laminated onto a firm but resilient supporting layer comprising a porous polyester felt with a polyurethane binder. Polishing pads typically may have a thickness in the range of 50–80 mils, preferably about 55 mils, and a diameter in the range of 10 to 36 inches, such as about 22.5 inches.

Polishing pads also may have macrotextured work surfaces made by surface machining using various techniques, many of which are expensive and produce undesirable surface features of widely varying depths. Surface features include waves, holes, creases, ridges, slits, depressions, protrusions, gaps, and recesses. Some other factors which influence the macroscopic surface texture of a polishing pad are the size, shape, and distribution frequency or spacing of the surface features. Polishing pads typically may also have microtextured surfaces cause by a microscopic bulk texture of the pad resulting from factors intrinsic to the manufacturing process. Since polishing does not normally occur across the entire pad surface, any microtexture of the pad and the macrotextures made by surface machining, may only be formed into the portion of the pad over which polishing is to take place.

During the polishing process, the material removed from the wafer surface and the abrasive, such as silica, in the slurry tend to become compacted and embedded in the recesses, pores, and other free spaces within the microscopic and macroscopic bulk texture of the polishing pad at and near its surface. One factor in achieving and maintaining a high and stable polishing rate is providing and maintaining the pad surface in a clean condition. Another factor is reducing or preventing a hydroplaning effect caused by the buildup of a layer of water between the abutting surfaces of the pad and the wafer. It has also been determined that increasing the flexibility of the pad in a controlled manner will increase polishing uniformity, i.e., the uniformity of the polished wafer surface.

Thus, consistently achieving uniform and high quality polishing of wafer surfaces by conventional pads has presented three problems. The first of these is the buildup of abrasive particles and debris between the pad and the wafer causing uneven polishing and damage to both the pad and the wafer. Secondly, uneven polishing due to hydroplaning between the wafer and the pad during conventional processes has resulted in the relatively high loss of product yield due to the resulting wafer damage. Thirdly, uneven polishing and wafer damage has also resulted from overly rigid pads produced by prior art manufacturing techniques. Therefore, there is a need for a method and apparatus for providing polishing pads capable of consistently producing high quality wafers with uniformly polished surfaces.

SUMMARY OF THE INVENTION

The present invention, therefore, provides a pad grooving method and apparatus for producing a polishing pad that is capable of consistently forming uniformly polished surfaces on high quality wafers. The apparatus comprises a platen with positioning post for holding a polishing pad in position for engagement by a router to machine grooves in the working surface of the pad. In order to precisely control the depth of the grooves as they are routed in the pad, a spacing mechanism provides a constant and precise separation between the working surface of the pad and the chuck for holding and rotating the router.

The pad is placed on the supporting surface of the platen with its working surface in spaced relation opposite to the router bit. The router chuck and drive motor are supported opposite to the pad by a frame. The spacing mechanism comprises at least one, preferably two or more, stop members mounted on the frame adjacent to an aperture through which passes the router bit. An outer end portion of the bit projects beyond the stop member(s), which preferably are pins threaded within the frame so as to be axially adjustable. A vacuum system is provided for applying a vacuum to the working surface of the pad to pull the pad first against the outer end of the router bit and then against the stop member (s).

Rotation of the router bit by the motor while the vacuum is applied to the pad causes the outer end portion of the bit to cut an initial recess (hole) into the pad to a depth below its working surface. The recess depth is precisely limited by the stop member(s), which comes into contact with the working surface of the pad as the rotating bit cuts into the pad to form the initial recess. After formation of the initial recess, a lateral motion mechanism causes relative lateral movement between the rotating router bit and the pad while the vacuum maintains the pad in contact with the stop member(s).

This lateral movement causes the rotating bit to cut a groove in the pad extending away from the initial recess and having a depth substantially the same as the initial recess depth. The lateral motion mechanism may comprise upper and lower plates suspended from an overhead beam and arranged for relative movement in the x-y plane. For example, the upper plate may be mounted on the overhead beam and driven in the X-direction (along the X-axis) by one or more motorized screws; and the router frame suspended from the lower plate which, in turn, is mounted on the upper plate and driven in the Y-direction by one or more motorized screws. As an alternative, the platen may be similarly mounted for such x-y movement instead of the router frame, or both the platen and router frame may be mounted for such movement In addition, the platen may be rotated by a drive motor to provide an additional means for causing lateral movement between the router bit and the pad.

It follows from the foregoing that relative movement between the stop member(s) and the pad in the Z-direction (along Z-axis) may be provided by the vacuum as it pulls the pad toward the router bit and the stop member(s). Where the polishing pad is flexible due to its large diameter and small thickness, there may be no need to guide this pad movement. Furthermore, significant pad movement along the Z-axis may be avoided by instead moving the router bit along the Z-axis, and then using the vacuum to maintain the bit depth during lateral movement between the bit and pad.

However motion of the pad along the Z-axis may be guided by a plurality, preferably two or more, posts projecting outward from the platen along axes parallel to the rotational axis of the router bit. These guideposts also may secure the pad for rotation when the platen is rotated by a platen drive motor, and are particularly useful for grooving disks other than polishing pads, such as rigid disks of greater thickness and smaller diameter. As already indicated, the upper and lower lateral motion plates provide for lateral movement of the router bit relative to the pad along the X-axis and along the Y-axis. Therefore, the router bit may be moved relative to the pad in accordance with the Cartesian coordinates x, y and z, or in accordance with the cylindrical coordinates R, θ and Z.

The foregoing relative lateral movements permit the grooves cut in the working surface of the pad to have either left or right spiral patterns, zigzag patterns with different groove densities, each following a constant radius around the pad at different radii, inner and outer circle grooves with spiral grooves or zigzag in areas therebetween, inner and outer sectors at different radii and having different spiral or zigzag patterns, or any combinations of these and other patterns. In addition, the patterned portions of the working surface of the pad may be confined only to those areas over which polishing of a wafer is to take place.

The depth of the grooves may also be varied for different patterns by axially adjusting the projecting length of the stop members, which are preferably symmetrical pins, or by axially adjusting the projecting length of the router bit relative to axially fixed stop members. To provide pads of increased flexibility, the grooves may penetrate into the pad for a depth up to 80% of the pad thickness. Pad flexibility may also be adjusted by the overall number of grooves provided, such as, for example, a pattern of 8, 32, or 64 spirals.

Grooves in the working surface of a CMP pad made according to the invention significantly reduce the hydroplaning effect during wafer polishing and, as a result, a much higher polishing rate can be achieved. A pattern with a higher number of spiral grooves can reduce the hydroplaning effect more efficiently than a pattern with a lower number of spiral grooves because more grooves will pass across the wafer surface being polished in the same period of time. An increase in pad flexibility due to the groove pattern selected may also help improve the polishing uniformity of the wafer surface. The groove density of zigzag groove patterns also may be varied to control the polishing rate distribution within different segments of the polishing pad surface and this may also improve polishing uniformity within the wafer surface.

The polishing pad provided by the present invention is ideal for polishing wafers of dielectric materials such as silicon dioxide, diamond-like carbon (DLC), spin-on-glass (SOG), polysilicon, and silicon nitride. The polishing pads also may be used to polish other wafers or disks such as those made of copper, aluminum, tungsten, and alloys of these and other metals.

BRIEF DESCRIPTION OF THE DRAWINGS

The features, operation, and advantages of the invention may be better understood from the following detailed description of the preferred embodiments taken in conjunction with the attached drawings, in which.

DETAILED DESCRIPTION OF THE PREFERRED EMBODIMENTS

Figure 2:
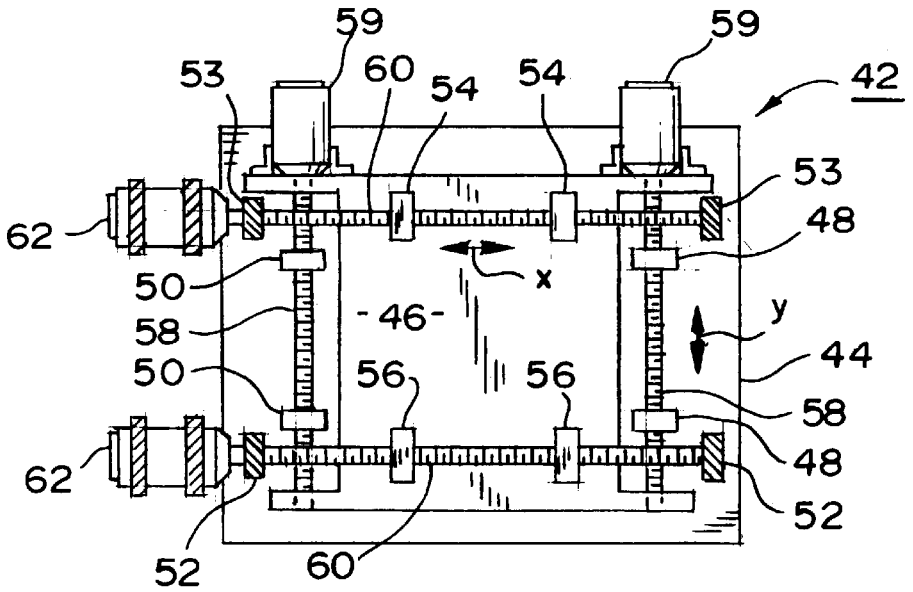
FIG. 2 is a planar cross-sectional view as taken along line 2—2 of FIG. 1.
Figure 1:
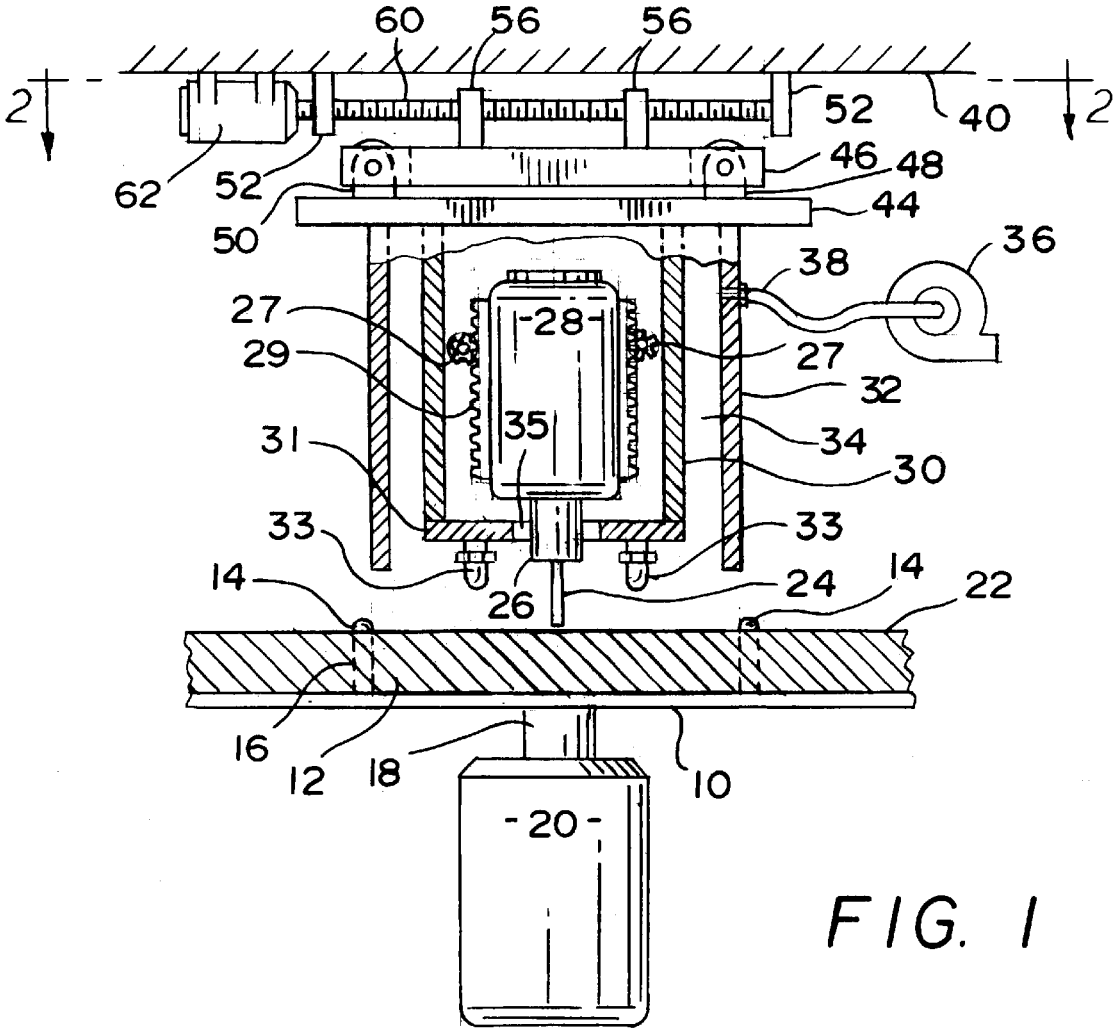
FIG. 1 is an elevational view of the invention in partial section and in which its major components are illustrated diagrammatically.
Figure 3:
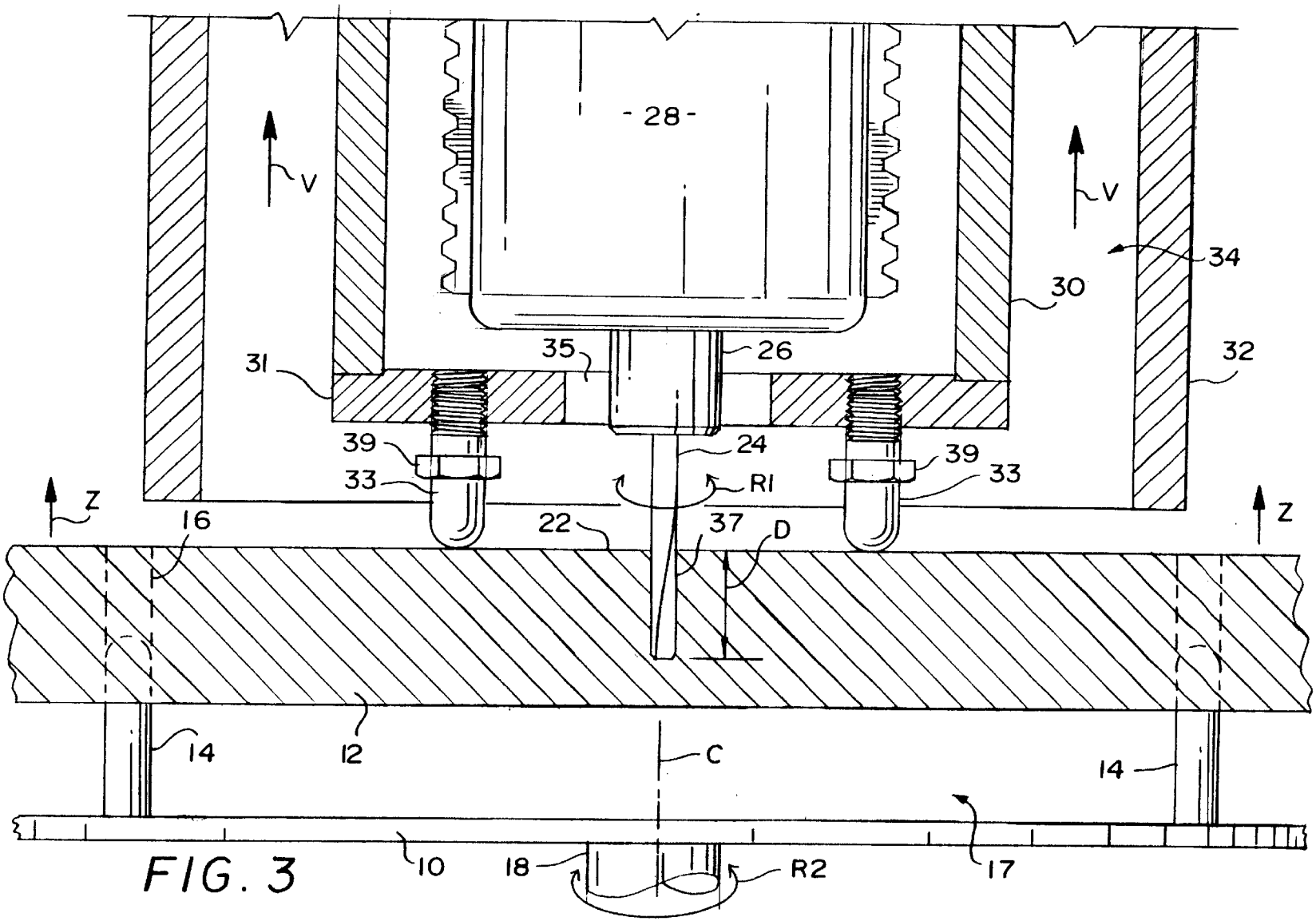
FIG. 3 is an enlarged partial sectional view of a portion of FIG. 1.
Figure 4:
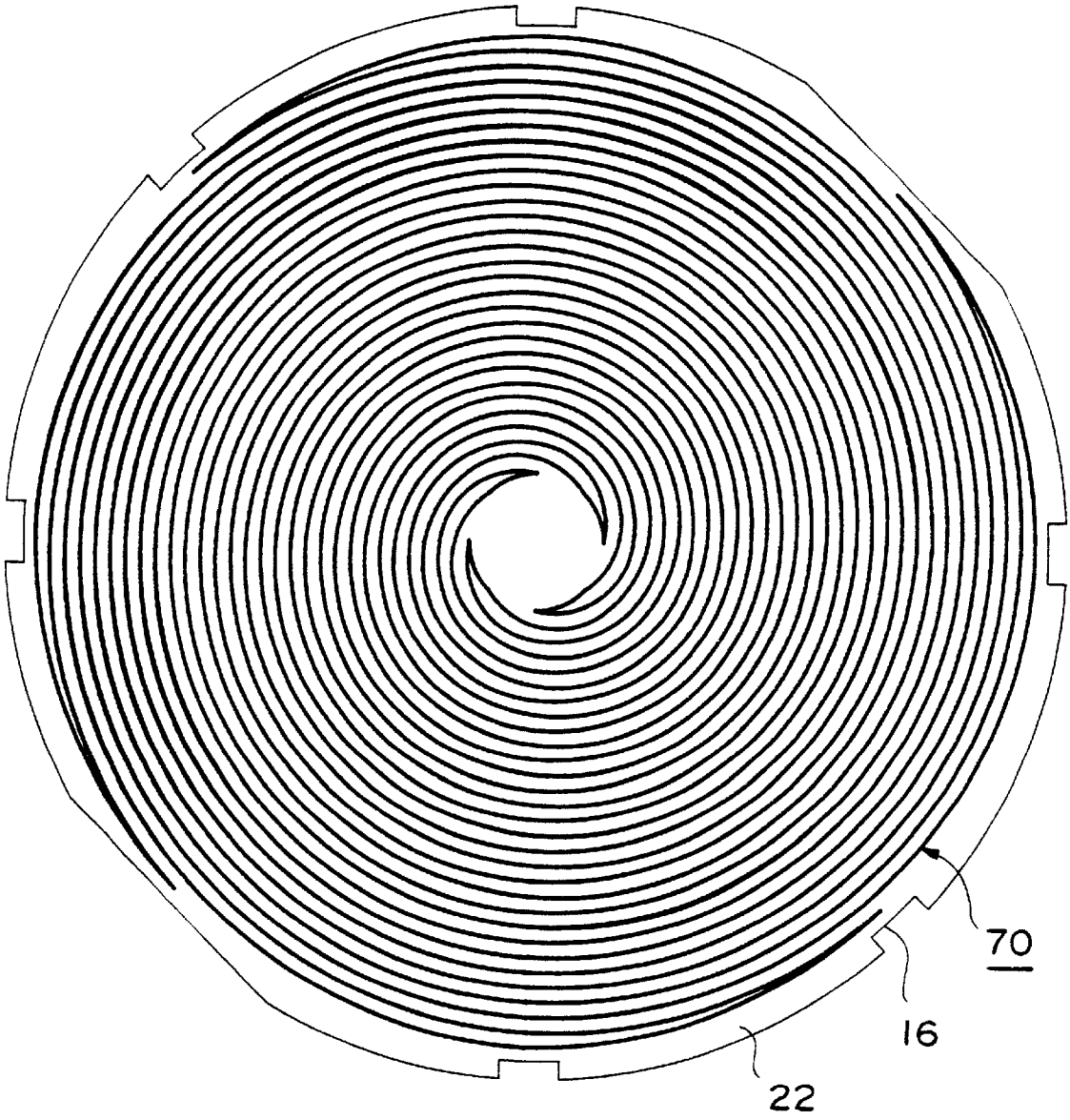
FIG. 4 shows a polishing pad made according to the present invention wherein the groove pattern comprises 8 left-hand spiral grooves beginning near the center of the pad and ending near the outer edge of the working surface of the pad.
Figure 5:
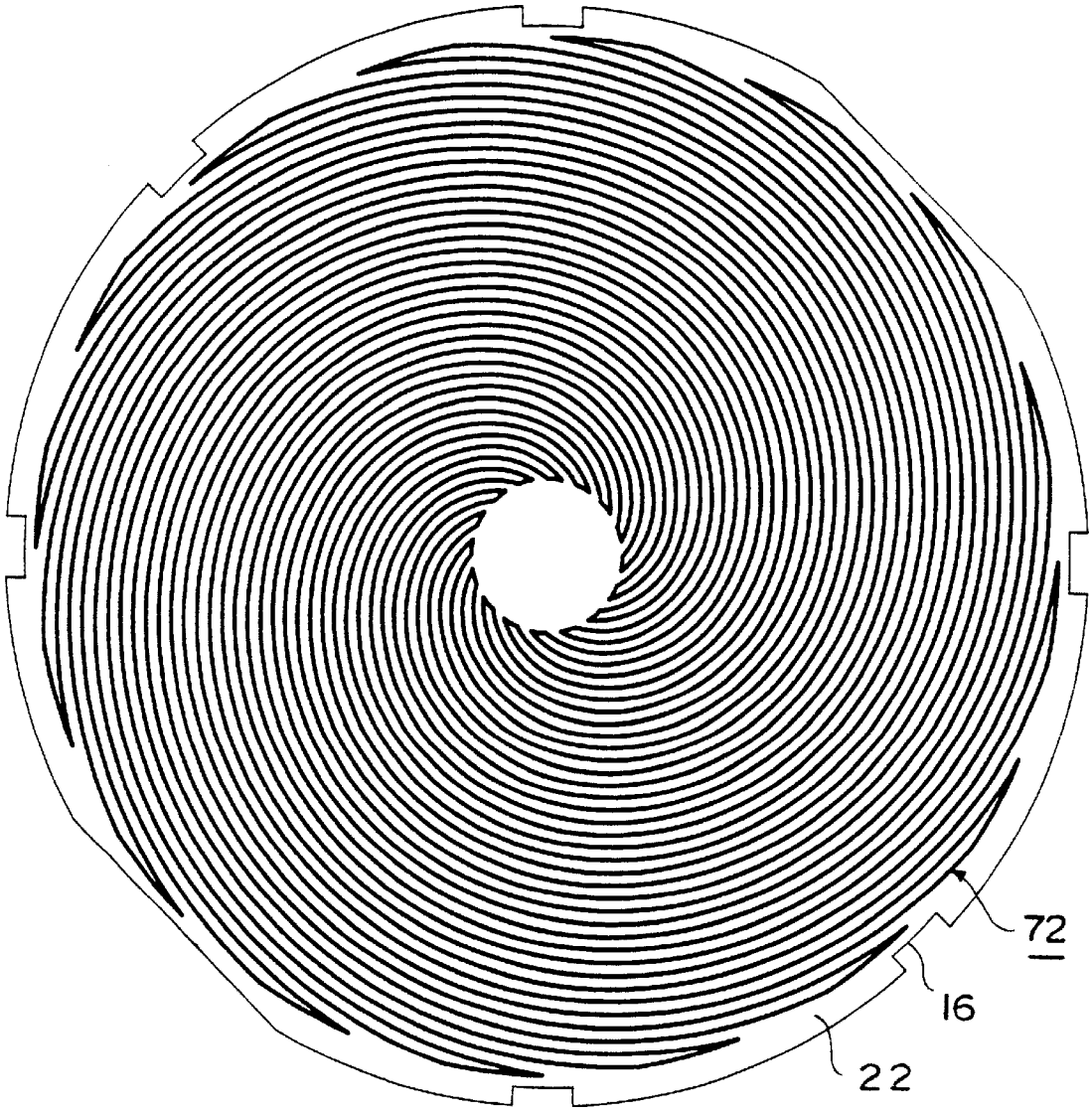
FIG. 5 shows a polishing pad made according to the present invention wherein the groove pattern comprises 32 left-hand spiral grooves beginning near the center and ending near the outer edge of the working surface of the pad.
Figure 6:
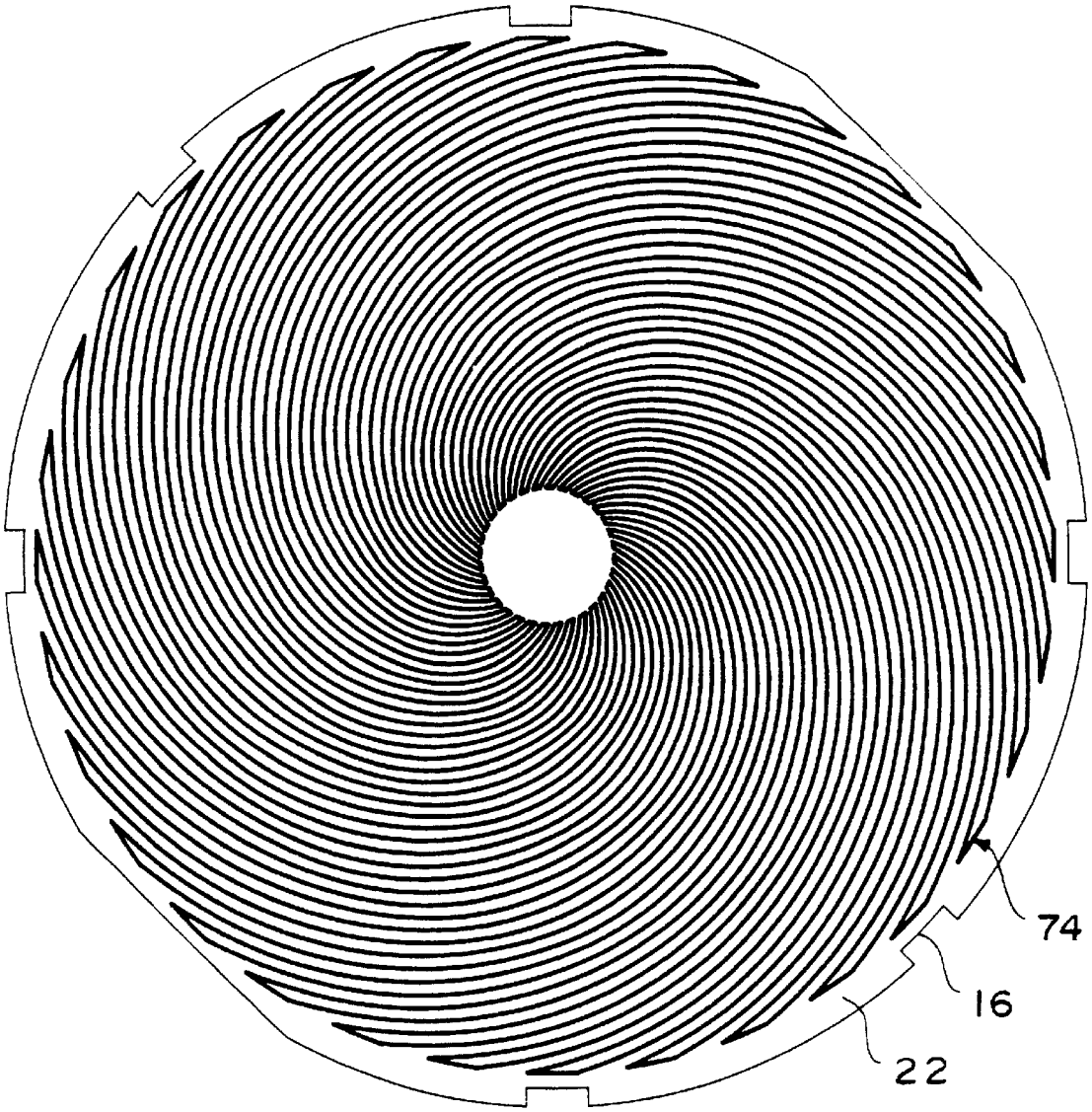
FIG. 6 shows a polishing pad made according to the invention wherein the groove pattern comprises 64 right-hand spiral grooves beginning near the center and ending near the outer edge of the working surface of the pad; and, FIG. 7 shows a polishing pad made according to the invention wherein the groove pattern comprises a plurality of radially spaced zigzag grooves each formed symmetrically along a substantially constant radius around the pad surface, and wherein the groove density of the innermost and outermost grooves are varied from each other and from intermediate grooves.

The polishing pad grooving method and apparatus of the present invention are illustrated best in FIGS. 1–3. The polishing apparatus has a platen 10 on which a polishing pad 12 is supported and held in a fixed radial position by a plurality of holding posts 14. Each of the holding posts 14 fits within a channel or recess 16 (FIG. 4) formed within the pad body or in the pad periphery and extending parallel to the central axis C of the pad so that the pad may be guided for axial movement away from the surface of the platen, as illustrated by the arrows Z and the air gap 17 shown in FIG. 3. However, for axially adjustable routers and/or flexible pads of sufficiently large diameter and small thickness to movement of the portion thereof being grooved, the holding posts 14 may be replaced by non-guiding clamps.

Positioned opposite to the working surface 22 of pad 12 is a router bit 24 replaceably held in a chuck 26 and driven in rotation by a router motor 28. Router motor 28 is carried by a frame 30 surrounded by a casing 32, such that an annular space 34 is provided between the concentric walls of the frame and the casing, both of which are preferably cylindrical. A vacuum, represented by arrows V, V is provided in the annular space 34 by a blower 36 attached to the casing 32 by a flexible hose 38. The platen 10 is carried for rotation in either direction by a drive shaft 18 driven by a platen motor 20. Motors 20 and 28 may both be of the reversible type, such that the router bit 24 may be rotated in either direction, as indicated by the arrow R1, and the platen 10 also may be rotated in either direction, as indicated by the arrow R2.

Mounted on the bottom wall 31 of the frame 30 adjacent to a passage 35 for the router bit 24 is a plurality of stop pins 33, which project parallel to the router bit for a distance that is less than the projecting distance of the router bit itself. The difference between the projecting distance of the pins 33 and the projecting distance of the router bit define the length of an end portion 37 of the bit equal to the desired depth of the groove to be cut by this end portion, as described more fully below in connection with operation of the invention. The projecting length of bit end portion 37 may be changed by rotating a pair of pinions 27, 27 that engage a corresponding pair of racks 29, 29 mounted on router motor 28 as shown in FIG. 1. The pins 33 are preferably threaded into the bottom wall 31 for axial adjustment, as an alternative means for changing the projecting length of bit end portion 37. Pins 33 may have a hex head portion 39 permitting engagement for rotation by a corresponding tool.

The router is mounted to an overhead support or carrying member 40 by a lateral motion mechanism, generally designated 42, to provide for lateral movement of the router bit in an x-y plane perpendicular to the axis of router bit rotation and the corresponding central axis C of the polishing pad. The lateral motion mechanism 42 may be any structure providing precise lateral movement of the router 24 in the x-y plane, and may not be needed in instances where the router support member 40 is itself movable in the x-y plane, such as where the member 40 is attached to or part of a precisely controllable robotic arm.

By way of example, the motion device illustrated in FIGS. 1 and 2 comprises a lower plate 44 suspended from an upper plate 46 by two pairs of threaded eyelets 48, 48 and 50, 50. In turn, the upper plate 46 is suspended from two pairs of brackets 52, 52 and 53, 53 by another two pair of threaded eyelets 54, 54 and 56, 56. Each eyelet pair 48, 48 and 50, 50 is threadedly engaged by a corresponding drive screw 58 driven in rotation by a reversible y-axis motor 59 to provide reciprocal motion of lower plate 44 along the y-axis, as illustrated by the double-ended arrow Y. Similarly, the eyelet pairs 54, 54, and 56, 56 are each threadedly engaged by a corresponding drive screw 60 rotated by a reversible x-axis electric motor 62 to provide reciprocal motion of upper plate 46 along the x-axis, as illustrated by the double-ended arrow X in FIG. 2.

Operation of the pad grooving apparatus will now be described with reference to FIGS. 1–3. The blower 36 is turned on to generate a vacuum V in the annular passage 34. This vacuum generates an upward force in the direction of arrows Z, Z to uplift and/or hold the pad 12 against the axially adjustable stop pins 33, which are thereby used to control the groove depth. The router bit 24 extends beyond the ends of stop pins 33 by the length of bit end portion 37, and will cut into the pad 12 when the bit is rotated by turning on the router motor 28. The router is preferably turned on and vertically adjusted after the vacuum is applied. Any upward movement of the pad, in response to the vacuum V, is guided by the engagement between the holding posts 14 and corresponding recesses or channels 16, which may be in the body or the periphery of the pad 12. The end portion 37 of the bit 24 may project beyond the tips of pins 33 by a length of up to 80% of the pad thickness, such that the end portion of the bit may penetrate to a depth up to 80% of the thickness of the pad. The projecting length of bit end portion 37 may be changed to thereby change the groove depth by turning the pinions 27, 27 or by turning the pins 33, 33, or by a combination of these adjustments After the router bit 24 has penetrated fully into the pad, as determined by abutment between the tips of stop pins 33 and the working surface 22 of pad 12, the bit is then moved radially relative to the pad in an x-y plane, as illustrated by the double-end arrows X and Y in FIG. 2. This x-y movement may be achieved solely by moving the lower plate 44 and the upper plate 46 relative to each other by operation of the motors 59 and 62, or these lateral movements may be combined with rotation of the platen 10 about the center axis C, while the router bit 24 is moved in a radial direction to form spiral grooves.

Lateral movement of the lower plate 44 along the y-axis is produced by the rotation of screws 58, 58 in threaded engagement with the respective eyes 48, 48 and 50, 50. Lateral movement of the upper plate 46 along the x-axis is produced by rotation of screws 60, 60 in threaded engagement with the eyes 54, 54 and 56, 56. Rotation of the platen 10 is provided by rotation of the shaft 18 by platen motor 20. Accordingly, the router bit 24 may be moved laterally in the x, y plane in the Cartesian coordinates x, y, or in the cylindrical coordinates R, θ with respect to the polishing pad 12. In addition, the router bit may be moved up and down along the Z-axis in both Cartesian and cylindrical coordinates by either hand or motorized rotation of the pinions 27 by conventional mechanisms that are not seen.

Upward movement along the z-axis in both Cartesian and cylindrical coordinates is also provided by movement of the pad 12 away from the surface 22 of platen 10 and against the tips of pins 33 in response to the creation of vacuum within annular passage 34. The pad moves downward along the z-axis when the vacuum ceases upon stopping blower 36. Such movement of the pad 12 along the z-axis is therefore produced by the pressure differential across the pad thickness as generated by the vacuum V. As an alternative, a pressure differential for causing such pad movement could be generated by ejecting pressurized air under the pad through a series of air holes or nozzles (not shown).

Thus, the spiral grooves formed by the present invention preferably (but not necessarily) start from the center of the pad and end near the outer edge thereof. The direction of the spiral pattern can either be to the left, as shown by the eight spiral grooves in FIG. 4 and the 32 spiral grooves in FIG. 5, or to the right, as illustrated by the 64 spiral grooves in FIG. 6. In FIGS. 4–7, the grooves are represented by heavy solid black lines for clarity because the opposing edges of the actual grooves are too close to be shown as double lines. As careful examination will reveal, a single continuous groove forms the patten 70 of FIG. 4, the pattern 72 of FIG. 5, and the pattern 74 of FIG. 6, such that, once inserted, the router bit does not have to be withdrawn until the pattern is completed.

The spiral grooves in the surface of the pad will reduce the hydroplaning effect during polishing and, as a result, a much higher polishing rate can be achieved. A higher number of spiral grooves within the same surface area can reduce the hydroplaning effect more efficiently than a lower number of spiral grooves because in the same period of time more grooves will pass across the surface of a wafer pressed against the pad surface during polishing of the former. It follows from this that the rate of removal of the slurried abrasive, which is used in combination with the pad for wafer polishing, will be greater the higher number of the spiral grooves per unit area of the pad working surface. A high number of grooves can also make the pad more flexible, which can help improve the uniformity of wafer polishing.

Figure 7:
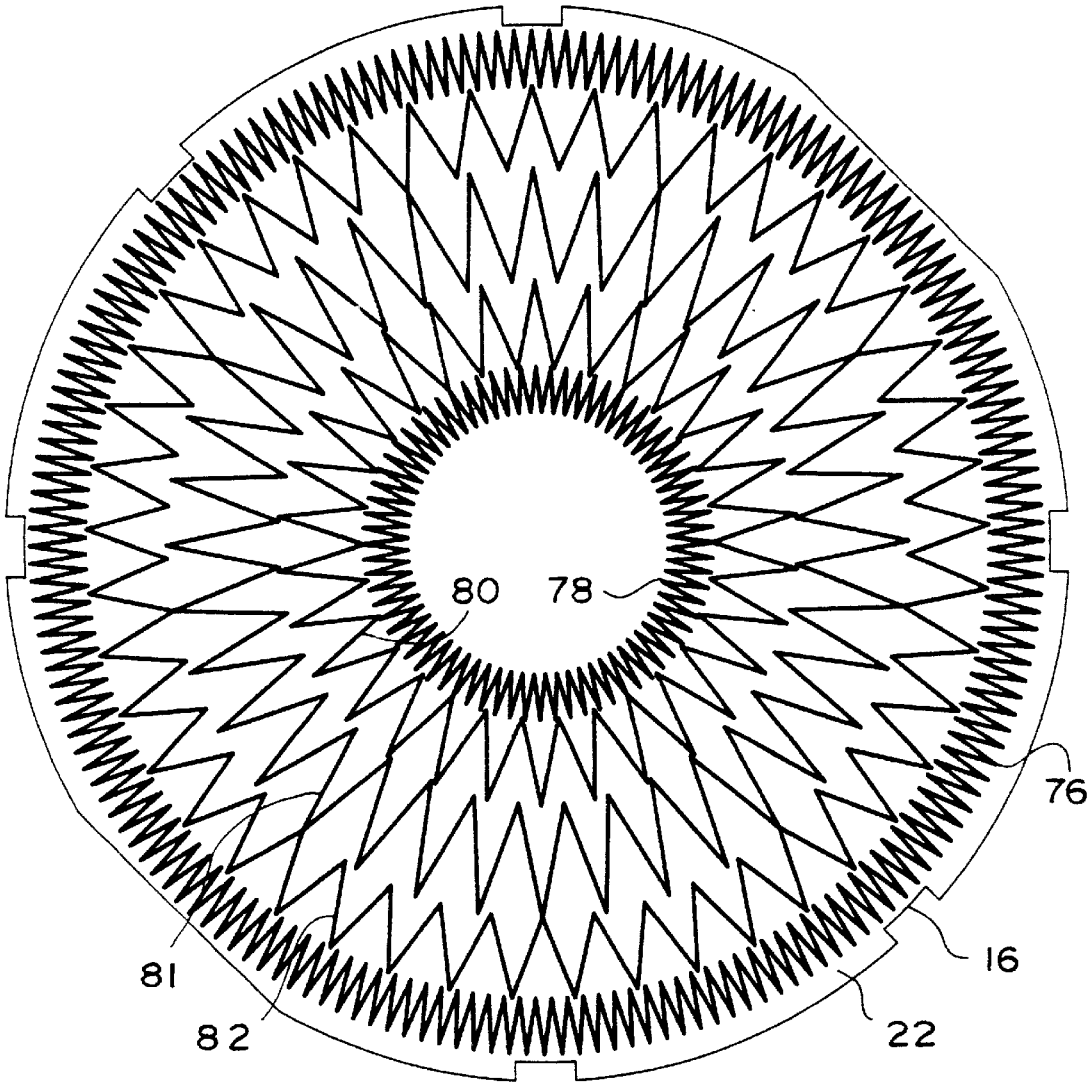

FIG. 7 illustrates a zigzag groove pattern consisting of an outer groove 76, an inner groove 78, and three intermediate grooves 80, 81, and 82. These grooves are made separately by stopping the blower to withdraw the bit from the pad, repositioning the bit laterally relative to the pad, and then restarting the blower to insert the bit into the pad. However, the grooves 76, 78, 80, 81, and 82 could be interconnected, in which case the pattern could instead be made by a single continuous groove to eliminate intermediate withdrawals of the bit from the pad. The groove pattern of FIG. 7 illustrates that the groove density may be varied over different portions of the pad surface. Such variations in groove density can be used to control the polishing rate distribution in accordance with where a wafer is pressed against the polishing pad surface, and this, too, can help improve the uniformity of wafer polishing. For generating the patterns shown in FIGS. 4–7 and other complex groove patterns, the positioning motors 20, 59, and 62 are preferably controlled by a microprocessor (not shown).

Person skilled in the art, upon learning of the present disclosure, will recognize that various changes and modifications to the elements and steps of the invention are possible without significantly affecting their functions. For example, the support structures for the pad and for the router, the nature and shape of the stop members for controlling the depth of the grooves, the arrangement for applying a pressure differential for holding the pad against the stop members, and the structures for providing relative lateral movement between the router bit and the pad, all as described above by way of example, may be varied widely in accordance with current and future technology for providing the functions of these systems and components. For example, the platen may include an array of air passages and outlets for providing a cushion of pressurized air under the pad to provide all or part of the pressure differential for holding the pad against the stop members. Also, in addition to being rotated, both the platen and the pad may be moved in an x-y plane by mounting the platen drive motor on a lateral movement mechanism similar to mechanism 42 for mounting the router motor as described above. Accordingly, while the preferred embodiments have been shown and described above in detail by way of example, further modifications and embodiments are possible without departing from the scope of the invention as defined by the claims set forth below.

What is claimed is:

1. A method for forming a groove in a pad comprising steps of:

placing said pad on a supporting surface with a working surface of the pad in spaced relation opposite to a router bit and to at least one stop member adjacent to said router bit, an outer end portion of said bit projecting towards said pad beyond said stop member, applying a pressure differential to said pad to cause the working surface thereof to move toward said stop member;

providing axial movement between said router bit and said pad and rotating said router bit to cause said outer end portion to form an initial recess by cutting into said pad to a depth below its working surface, said recess depth being limited by said pressure differential causing the working surface of said pad to move into contact with said stop member; and providing lateral movement between said rotating router bit and said pad while the working surface of said pad is maintained in contact with said stop member by said pressure differential to cause said rotating bit to cut a groove that extends laterally away from said initial recess and has a depth substantially the same as said recess depth.

2. A method according to claim 1, wherein said pressure differential is created at least in part by applying a vacuum to the working surface of said pad.

3. A method according to claim 1, wherein said lateral movement between said router bit and said pad is such that the outer end portion of said bit cuts at least one spiral groove in the working surface of said pad.

4. A method according to claim 3, wherein said lateral movement between said router bit and said pad is such that the outer end portion of said bit cuts at least 8 spiral grooves in the working surface of said pad.

5. A method according to claim 4, wherein said lateral movement between said router bit and said pad is such that the outer end portion of said bit cuts at least 32 spiral grooves in the working surface of said pad.

6. A method according to claim 4, wherein said lateral movement between said router bit and said pad is such that the outer end portion of said bit cuts at least 64 spiral grooves in the working surface of said pad.

7. A method according to claim 1, wherein said lateral movement between said router bit and said pad is such that the outer end portion said bit cuts at least one zigzag groove extending to either side of a substantially constant radius to provide an annular segment of said pad working surface with a zigzag groove pattern.

8. A method according to claim 1 further comprising steps of stopping said pressure differential, repositioning said pad relative to said bit, and reapplying said pressure differential to said pad such that the outer end portion of said bit is periodically withdrawn from and reinserted in said pad to form a plurality of said grooves.

9. A method according to claim 1, wherein said lateral movement comprises moving said rotating bit laterally relative to said pad while simultaneously rotating said pad about said central axis.

10. An apparatus for forming a groove in a pad comprising:

a router and at least one projecting stop member mounted on a frame, said router comprising a bit positioned adjacent to said stop member and a drive motor for rotating said router bit, and said bit having an outer end portion of a length projecting beyond said stop member;

a surface for supporting the pad with a working surface thereof in spaced relation opposite to said router bit and said stop member;

an axial movement means for providing axial movement between said router bit and said pad such that rotation of said bit forms an initial recess by cutting into said pad to a depth below its working surface;

a fluid system for applying a pressure differential to said pad to cause the working surface of said pad to contact said stop member to limit said recess depth; and a lateral movement mechanism for causing lateral movement between said rotating router bit and said pad while the working surface of said pad is maintained in contact with said stop member by said differential pressure to cause said rotating bit to cut a groove that extends laterally away from said initial recess and has a depth substantially the same as said recess depth.

11. An apparatus according to claim 10, wherein said fluid system comprises a vacuum system for applying a vacuum to the working surface of said pad.

12. An apparatus according to claim 10, wherein said supporting surface is provided by a platen, wherein at least part of said axial movement is provided by said differential pressure, and wherein said axial movement means further comprises at least one guide post mounted on said platen for engaging a corresponding channel in said pad for guiding said pad for movement against said bit and said stop member.

13. An apparatus according to claim 10 comprising a plurality of stop members each including a pin threaded within a member of said frame so as to be axially adjustable for changing the depth of said recess and said groove.

14. An apparatus according to claim 10, wherein said lateral movement mechanism comprises a platform for supporting said router and moving said rotating router bit laterally in at least one direction transverse to a rotational axis of said router bit.

15. An apparatus according to claim 10, wherein said lateral movement mechanism comprises a drive motor for rotating said supporting surface and means on said supporting surface for engaging said pad for rotation therewith, such that the lateral movement of said rotating bit while said platen is rotating forms a spiral groove in the working surface of said pad.

16. An apparatus according to claim 15, wherein said lateral movement mechanism further comprises a platform for supporting said router and providing lateral movement of said rotating bit in a plurality of directions in an x-y plane transverse to a rotational axis of said bit, such that the location of said router bit relative to said pad working surface may be defined by cylindrical coordinates R, $\theta$ and said lateral movement is capable of forming one or more spiral grooves in said pad working surface.

17. An apparatus according to claim 10, wherein said lateral movement mechanism comprises a platform for supporting said router for movement in a plane transverse to an axis of rotation of said router bit such that the location of said router bit relative to said pad working surface may be defined by the Cartesian coordinates x, y, and said lateral movement is capable of forming one or more grooves in said working surface.

18. An apparatus according to claim 17, wherein the lateral movement provided by said lateral movement mechanism is capable of causing said rotating router bit to form at least one zigzag groove extending to either side of a substantially constant radius to provide an annular segment of said pad working surface with a zigzag groove pattern.

19. An apparatus according to claim 10, wherein said axial movement means comprises an axial movement mechanism for changing the projecting length of the outer end portion of said bit by moving said bit along an axis of its rotation.

* * * * *

UNITED STATES PATENT AND TRADEMARK OFFICE

CERTIFICATE OF CORRECTION

PATENT NO. : 6,340,325 B1
DATED : January 22, 2002
INVENTOR(S) : Chen et al.

It is certified that error appears in the above-identified patent and that said Letters Patent is hereby corrected as shown below:

Title page,
Item [*] Notice, delete the phrase "by 0 days" and insert -- by 12 days --

Signed and Sealed this

Twenty-first Day of September, 2004

JON W. DUDAS
*Director of the United States Patent and Trademark Office*